US005568085A

United States Patent [19]

Eitan et al.

[11] Patent Number: 5,568,085

[45] Date of Patent: Oct. 22, 1996

[54] UNIT FOR STABILIZING VOLTAGE ON A CAPACITIVE NODE

[75] Inventors: Boaz Eitan, Ra'anana, Israel; Reza Kazerounian, Alameda, Calif.; Alex Shubat; John H. Pasternak, both of Fremont, Calif.

[73] Assignee: WaferScale Integration Inc., Fremont, Calif.

[21] Appl. No.: 242,947

[22] Filed: May 16, 1994

[51] Int. Cl.[6] ..... G05F 1/10

[52] U.S. Cl. ..... 327/546; 327/530; 326/33

[58] Field of Search ..... 327/530, 538, 327/543, 545, 546, 109, 111, 535, 534, 539; 365/226; 326/33, 34, 119, 204, 203, 189.09, 189.11; 323/313, 315

[56] References Cited

U.S. PATENT DOCUMENTS 4,477,736 10/1984 Onishi ..... 327/543
4,638,187 1/1987 Boler et al. .
4,694,199 9/1987 Goetz ..... 327/543
4,812,735 3/1989 Sawada et al. ..... 327/543
5,296,757 3/1994 Koizumi ..... 327/530
5,329,175 7/1994 Peterson .
5,362,988 11/1994 Hellums ..... 327/530

*Primary Examiner*—Timothy P. Callahan
*Assistant Examiner*—Jung Ho Kim
*Attorney, Agent, or Firm*—Skjerven, Morrill, MacPherson, Franklin & Friel; Forrest E. Gunnison

[57] ABSTRACT

A unit for stabilizing the voltage on a capacitive node of a memory array, such as a common node bit line (CNBL), is disclosed. The unit includes an amplifier connected to the CNBL line and to one voltage source and a leaker connected to the CNBL line and to the other voltage supply, where the two voltage supplies can be the positive and ground supplies. The leaker is much smaller then the amplifier thereby to remove current from the CNBL line when there is little or no activity in The memory array. An alternative version of the unit which is also operative for standby operation is disclosed. In this embodiment, there is a switchable high power unit activatable during an active mode and a low power unit. Both units include an amplifier and a leaker connected as in the previous embodiment. The leakers are much smaller then the amplifiers and the amplifier of the high power unit is much larger than the amplifier of the low power unit. The high power unit also includes control transistors for disabling its amplifier and leaker during the standby mode.

5 Claims, 4 Drawing Sheets

UNIT FOR STABILIZING VOLTAGE ON A CAPACITIVE NODE

FIELD OF THE INVENTION

The present invention relates to control of bit line reference levels in memory arrays generally and in virtual ground memory arrays in particular.

BACKGROUND OF THE INVENTION

Reference is now made to FIG. 1 which illustrates a prior art virtual ground memory array. The memory array typically comprises columns of bit lines 10 between which are columns of memory cells 12. The bit lines 10 are typically switchably connected, via EQ transintors 13, to a capacitive node known as the "common node bit line" (CNBL line) which, in turn, is connected to an amplifier or pull-up transistor 14. Each bit line 10 is additionally connected to a small keeper transistor 16 and to a Y-decoder 18. The transistors 13, 14 and 16 are n-channel transistors.

EQ transistors 13 are each controlled by an EQ line and the pull-up transistor 14 and the keeper transistors 16 are controlled by a blvref line carrying a generally steady reference voltage. For a 2 V CNBL voltage and a 0.8 V threshold of the n-channel transistors 14 and 16, the blvref voltage is approximately 3.2 V.

Prior to accessing a memory cell 12, the EO transistors 13 connect the bit lines 10 to the CNBL line and enable the memory array to become pre-charged to a pre-charge voltage level, typically of 2 V.

Prior to accessing a memory cell 12, the bit lines 10 are disconnected from the CNBL line. During access of a memory cell 12, one of its neighboring bit lines 10 (the one which becomes the source line) is grounded and the voltage on the other neighboring bit line 10 (which becomes the drain line) is connected through the Y-decoder 18 to a sense amplifier (not shown) which senses the state of the data stored in accessed memory, cell 12.

During accessing, the keeper transistors 16 maintain the voltage levels of the other bit lines 10 at or dose to the pre-charge voltage level which, for the above example, is 2 V. The keeper transistor 16 on the bit line of the accessed memory cell 12 also fights the activity of the accessed memory cell. However, as long as the read signal that can be detected on the drain line is small, say of 100 mV, the drain-to-source voltage Vds on keeper transistor 16 is small. Since, by design, the size W/L of the keeper transistors 16 is small, the action of the keeper transistor 16 on the accessed bit line practically does not affecting the memory cell read.

Once the data from the memory cell 12 has been read, the EQ transistors 13 can reconnect the entirety of bit lines 10 to the CNBL line, thereby enabling the memory array to redistribute its charge. The charge redistribution pre-charges the used bit lines 10 but reduces the charge level of the CNBL line. In response, the pull-up transistor 14 pulls the CNBL line to the pre-charge voltage level. Since the keeper transistors 16 kept the unused bit lines 10 at close to the pre-charge voltage level, the change in the voltage of the CNBL line due to charge redistribution is on the order of 200 mV which is relatively small.

The memory array typically has two modes of operation, an active mode in which the memory cells 12 are accessed every access time $t_{aa}$ nanoseconds and a standby mode during which no activity occurs and therefore, there is no current in the memory array. A typical value for $t_{aa}$ in non-volatile memory products is in the range of 25–200 nanoseconds.

During the active mode, the charge redistribution and corresponding pull-up activity provides an average current for transistor 14 on the order of milliamperes. During the standby mode, the only current that transistor 14 must replenish is its junction leakage current which is less then a picoampere.

FIG. 2, to which reference is now made, is a log-linear chart which illustrates an exemplary current-voltage graph 23 for the pull-up transistor 14, where, for example, the pull-up transistor 14 has a size of 2000/1.1 μm. It is noted that the voltage on the CNBL line is the source voltage of transistor 14. The $V_{CNBL}$ level is determined by the voltage level of blvref, which for curve 23 is 3.2 V, and the amount of current flowing out of the CNBL node.

For $V_{CNBL}$ from 0 to 1.4 V, pull-up transistor 14 is in saturation. For $V_{CNBL}$ at approximately 0 V, transistor 14 conducts several tens of milliamperes. For $V_{CNBL}$ at 1.6 V, transistor 14 conducts a few milliamperes (point 20 on graph 23). From 1.6 V to 1.8 V (from point 20 to point 22), transistor 14 is in transition to a subthreshold state. In the active state, (i.e. voltages greater then 1.8 V), as $V_{CNBL}$ increases, the current drops by about one order of magnitude for every 90 to 100 mV.

For a constant blvref, which is generally available, a decrease in the current from 100 μA to 10 μA will increase the CNBL voltage level $V_{CNBL}$ by 90 mV from 1.8 V to 1.89 V and a current increase to 1 mA will reduce the CNBL voltage level $V_{CNBL}$ 150 mV from 1.8 V to 1.65 V.

It is noted that, if the CNBL current is constant, which is a rare situation, the voltage level $V_{CNBL}$ changes in one-to-one correlation with the steady blvref voltage. For example, a blvref of 4.2 V will produce a CNBL voltage level $V_{CNBL}$ of 2.8 V and a CNBL current of 100–200 μA.

When the memory array is active, the transistor 14 typically operates with a variable current level between 1 mA and 100 s of microamperes. Thus, its maximum voltage level is approximately 1.6 V, which is indicated by point 20.

When the memory array is in standby mode, the current is typically on the order of picoamperes and the operating point is near a point 24. As can be seen when contrasting points 20 and 24, the reduction of current, during standby, by eight orders of magnitude increases the CNBL voltage level $V_{CNBL}$ to about 2.5 V. This is problematic.

Furthermore, the keeper transistors 16 also follow a similar current-voltage graph, except that, since they are smaller, the graph, labeled 25 in FIG. 2, begins at a lower level. However, its slope is mode, identical to that of graph 23. If the memory array is in standby during which the EQ transistors 13 are inactive, the voltage levels of the bit lines 10 are defined by the leakage current of the keeper transistors 16. For example, If the keepers 16 are part of a 1 Mbit array with 1000 bit lines and are 1000 times smaller them transistor 14, their leakage current (during standby) is 1000 times smaller then that of the transistor 14 and therefore, their standby operating point, labeled 27, has the same voltage as the standby operating point 24 of the transistor 14. In other words, during standby, the keepers 16 provide the bit lines 10 with a voltage level of about 2.5 V.

When reading a memory cell 12, its neighboring bit lines 10 are typically quickly brought to their voltage levels for reading by the Y-decoder 18. The data in the memory cell 12 is determined by comparing the output of the reading bit line to that of a reference bit line attached to a memory cell whose data value is known.

Normally, this poses no problem. However, if the memory array has been in standby mode, the keeper transistors 16 have raised the voltages on all the bit lines 10. Prior to reading a memory cell, the memory array is equalized; however, when the voltages are too high, the equalization typically does not return the voltages to their pre-standby values. A bit line which previously was a source line (i.e. at ground) will start, in this case, from a non-equalized state while the reference bit line against which it may be read will be at the pre-charged level. To read such a bit line will take longer to generate the correct signal then is allotted and an incorrect reading will be produced. The result is a failed memory array.

The voltage difference between the reference bit line and the reading bit line is added to the voltage that the memory cell generates. Since it takes longer to generate a larger signal and the time allotted for producing a signal is fixed, the signal which is produced in this case will be lower then it should be. How serious this problem is depends on how much time the memory array spends in the standby mode and the voltage level it comes to as a result.

Another example of the problem of varying CNBL currents which leads to a problem is the reading of a "1" after reading a "0". When a "1" is read from a memory cell, about 100 μA of current per memory cell is pulled from the active bit line 10 and therefore, during pre-charge, the pull-up transistor 14 requires current in the order of milliamperes in order to equalize the memory array. If a "0" is read, no current is pulled from the active bit line 10. Normally this is of no consequence. However, if the memory cells 12 of a single bit line 10 are read consecutively and they all have "0"s stored therein, only the junction leakage current is pulled from the active bit line 10 and therefore, its voltage level increases, as in the standby mode, towards keeper operating point 27. This causes incorrect data reading problems such as described hereinabove for the standby mode, It is therefore desired to stabilize the CNBL voltage level $V_{CNBL}$ and the voltage of the bit lines connected to it, between the active and standby modes to a range much less then the 0.5–0.7 V of the prior art circuits.

Prior art memory arrays solve the active vs. standby problem by providing different voltage levels for the blvref signal, one for each mode thereby, providing transistor 14 with two operating regions. This solution is optimized for one operating temperature and for one set of process conditions. If the temperature or process condition changes, the two levels for the blvref signal also change. Hence, this solution still maintains a wide range of CNBL levels and does not solve the wide operating range problem.

SUMMARY OF THE PRESENT INVENTION

It is therefore an object of the present invention to provide a mechanism for more steadily maintaining the voltage on the capacitive node known as the CNBL line regardless of the current being drained out of it. The present invention does so by having an amplifier and a leaker connected to the CNBL line, each connected to a different one of the positive and ground supplies. The leaker removes small amounts of current, typically, about 10% of the average active current, away from the CNBL line.

When the CNBL line is active the current removal does not significantly affect the CNBL voltage level. When the memory array is not active or widen the bit lines have not pulled much current from the CNBL line, the leakers remove enough current to keep the CNBL line at a desired, maximum, voltage level. For a given size of the amplifier and a given steady bit line reference voltage (blvref) level which is higher than a threshold level of the amplifier and the leaker, the leaker defines the highest voltage level which can exist on the CNBL line.

The leaker also defines the lowest voltage level on the CNBL line which is a function of the highest current level. The highest current level is about 10 times the level of the current removed and is present during the active mode. As long as the amplifier operates in the subtle threshold region, the resultant voltage level for the active mode is approximately 100 mV lower then that for the non-active mode.

For memory arrays with standby modes, the present invention has two portions, a high power unit which is active only during the active mode and an always active low power unit. Both units include an amplifier and a leaker connected as in the previous embodiment. The leakers are much smaller then the amplifiers and the amplifier of the high power unit is much larger then the amplifier of the low power unit. The high power unit also includes control transistors for disabling its amplifier and leaker during the standby mode. The leaker and amplifier of the low power unit have the same size ratio acid control voltage levels as the amplifier and leaker of the higher power unit and hence, control the CNBL line in the same way. The sizes of the amplifier each leaker of the low power unlit are designed to meet the power requirement for the standby mode.

The leakers and amplifiers can be both n-channel transistors, in which case the amplifiers are connected to the positive supply and the leakers are connected to the ground supply. In the switchable high power unit, the leaker control transistor is an n-channel transistor and the amplifier control transistor is a p-channel transistor.

Alternatively, the leakers and amplifiers can be both p-channel transistors, in which case the amplifiers are connected to the ground supply and the leakers are connected to the positive supply. For this alternative embodiment, in the switchable high power unit, the leaker control transistor is a p-channel transistor and the amplifier control transistor is an n-channel transistor.

BRIEF DESCRIPTION OF THE DRAWINGS

The present invention will be understood and appreciated more fully from the following detailed description taken in conjunction with the drawings in which.

Figure 4:
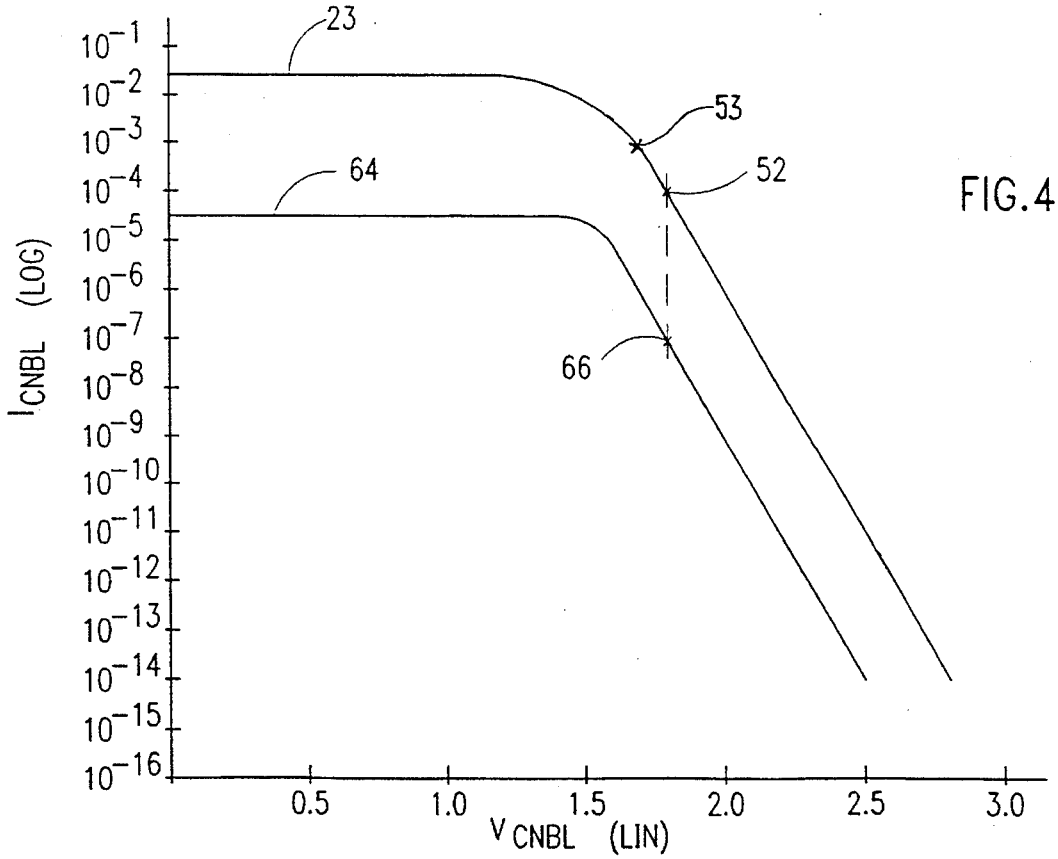
Figure 3A:
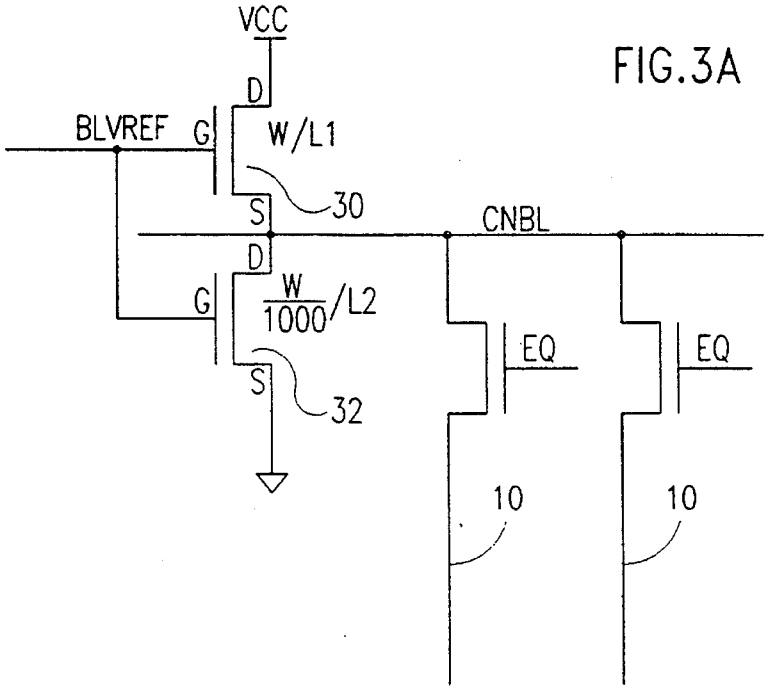
Figure 3B:
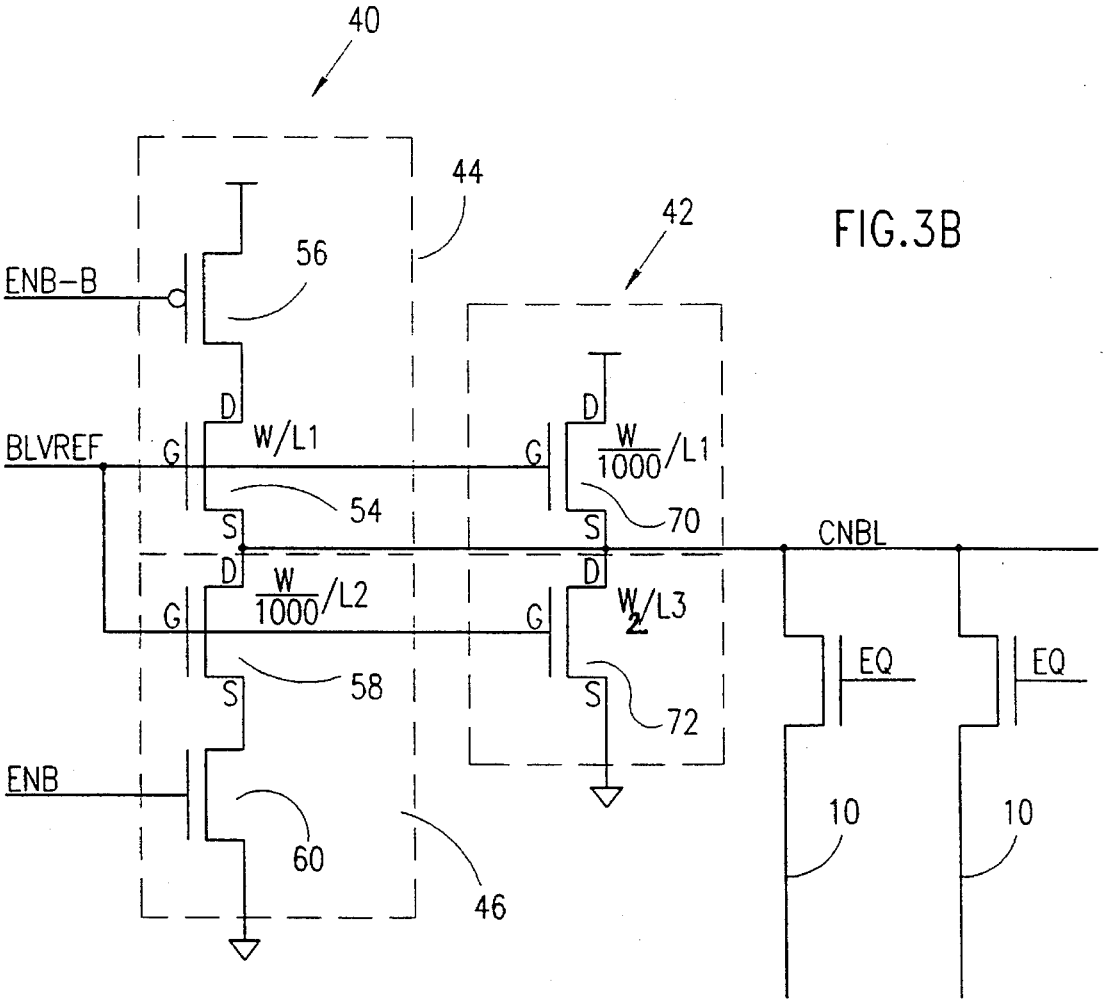
Figure 5:
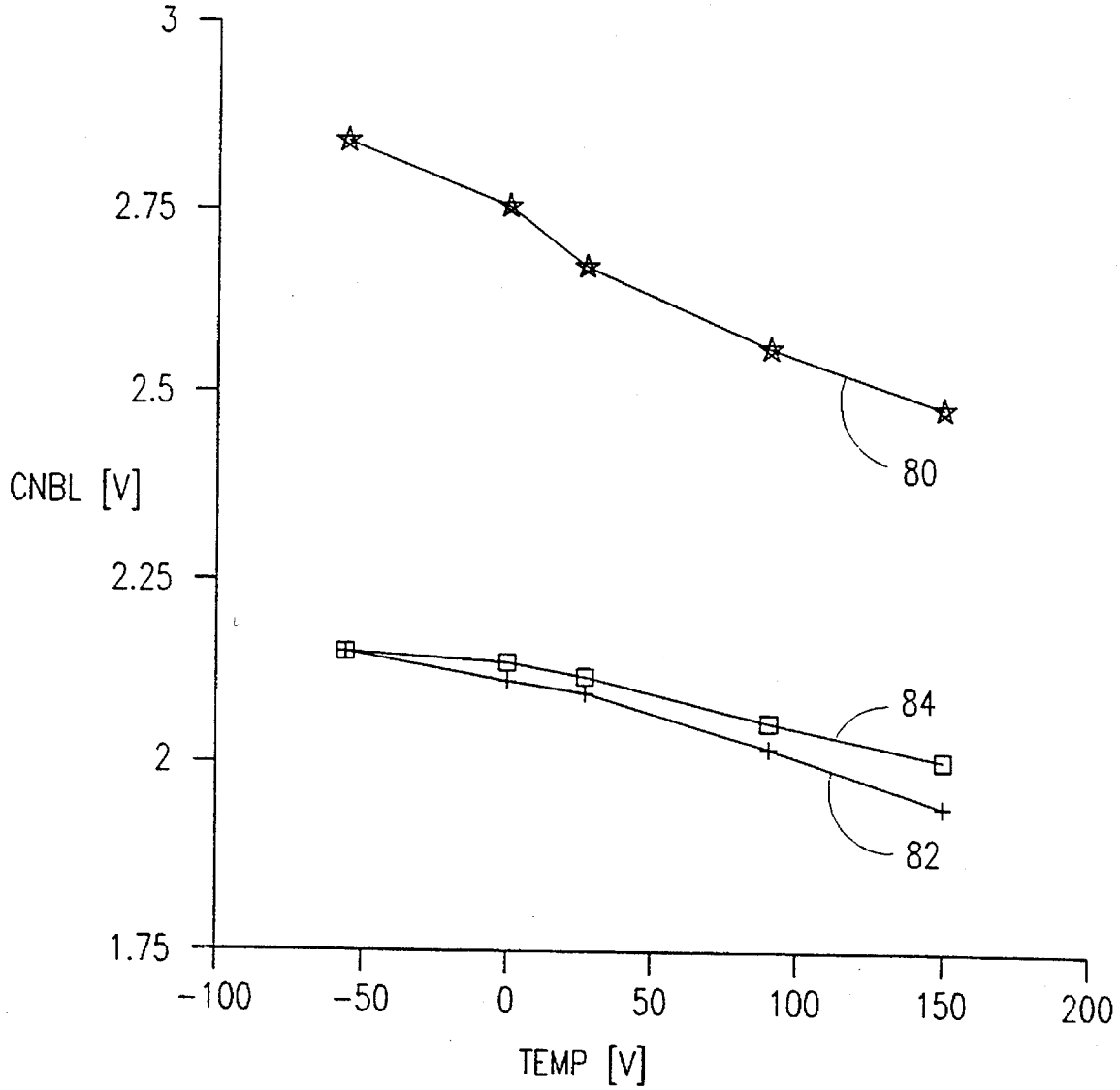

FIG, 2 is a graphical illustration of the relationship between current and voltage on a CNBL line;

FIGS. 3A and 3B are schematic illustrations of two alternative CNBL voltage level maintaining circuits, constructed and operative in accordance with preferred embodiments of the present invention;

FIG. 4 is a graphical illustration of the relationship between current and voltage on a CNBL line and indicates the operating points of the circuits of FIGS. 3A and 3B; and FIG. 5 is a voltage-temperature graph illustration of the worst case operating voltage across a set of voltages, for the prior art and the low and high power modes of the present invention.

DETAILED DESCRIPTION OF A PREFERRED EMBODIMENT

Reference is now made to FIGS. 3A and 3B which illustrate two CNBL voltage level maintaining circuits, constructed and operative in accordance with a preferred embodiment of the present invention. Reference is also made to FIG. 4 which illustrates the current-voltage relationships of the circuits of the present invention.

The voltage level maintaining circuit of the present invention comprises an amplifier 30 and a leaker 32. As shown in the example of FIG. 3A, amplifier 30 is a pull-up n-channel transistor and leaker 32 is a pull-down n-channel transistor. Without loss of generality, amplifier 30 could be a pull-down p-channel transistor and leaker 32 could be a pull-up p-channel transistor. For the purposes of clarity, the description will focus on the n-channel solution shown in FIGS. 3A and 3B.

In the circuit of FIG. 3A, the source S of amplifier 30 is connected to the CNBL line, its drain D is connected to the positive supply Vdd and its gate G is controlled by the voltage reference blvref. The drain D of leaker 32 is connected to the CNBL line, its source S is connected to the ground supply Vss and its gate G is also controlled by the voltage reference blvref. The voltage reference blvref is steady and is higher then the threshold levels of the amplifier 30 and the leaker 32. For the example shown herein, it is 3.2 V.

Since, as will be described hereinbelow in detail, the circuit of the present invention is operative to provide a maximum voltage level (and a minimum current level) for the CNBL line, the keeper transistors of the prior art, which raised the voltage level of the CNBL line, have been eliminated.

The amplifier 30 acts as a regular pull-up transistor, pulling the CNBL voltage level $V_{CNBL}$ towards the positive supply Vdd. Since the leaker 32 is connected to the ground source Vss, leaker 32 leaks current away from the CNBL line in opposition to the activity of the amplifier 30.

The amplifier 30 is large, of size W/L. For example, W might be 2000 μm, and L might be 1.1 μm. The leaker 32 is significantly smaller, for example, a few orders of magnitude smaller (i.e. (W/L)/1000), and therefore, its opposition to the amplifier 30 is small.

Figure 1:
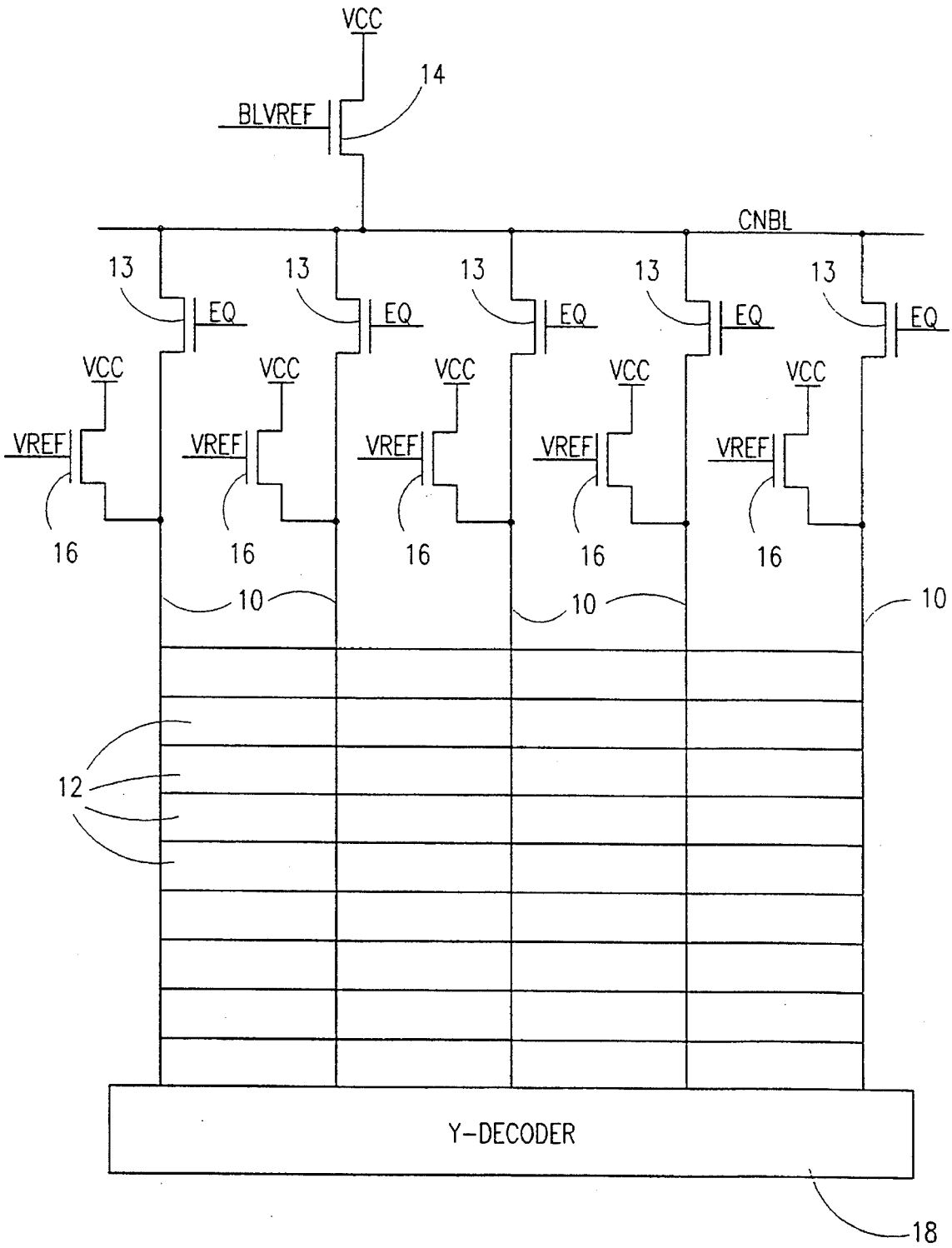
FIG.1 PRIOR ART
FIG. 1 is a schematic illustration of a portion of a prior art memory array.
Figure 2:
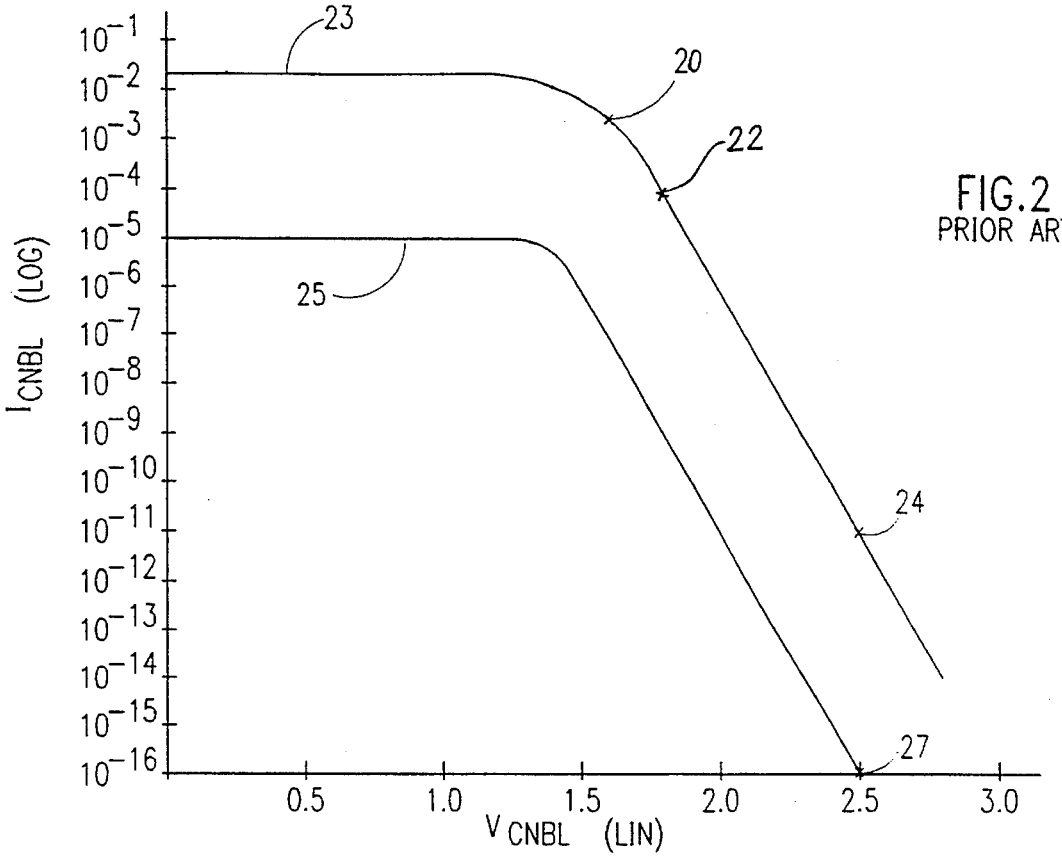
FIG. 2 PRIOR ART

FIG. 4 illustrates the relationship between current and CNBL voltage level $V_{CNBL}$ and is similar to FIG. 2. Curve 23 is the same curve as is shown in FIG. 2.

Due to the continual flowing of current caused by leaker 32, the circuit of the present invention has a maximal operating point 52 on curve 25 whose current level is the minimum current which the circuit can have. Point 52 has a current level on the order of 100s of microamperes and a voltage level $V_{CNBL}$, which is the maximum voltage level of the circuit, of 1.8 V. In other words, when there is no other activity in the array the circuit operates at point 52 which is determined by the amount of current removed by leaker 32.

On the other hand, when there is activity in the array, the current level is that of the array increased by the amount of current removed by leaker 32. The maximum CNBL current is equivalent to the maximum current in the array plus the current removed by leaker 32 and should be about 10 times higher then the current removed by the leaker 32 (the point labeled 53). Point 53 defines the maximum CNBL current level (lowest CNBL voltage level) of the circuit.

Therefore, the amount of current which the leaker 32 removes is the lowest current level which the circuit can have. Point 52 indicates the operating point when there is no activity in the array which is the highest voltage level possible for the memory array regardless of the activity of the array (i.e. during the standby mode and in the situation of reading many 0's from the same bit line, the leakers 32 remove current and thereby keep the CNBL voltage level at a maximum).

The size of the leaker 32 is a function of the blvref voltage level, of the size of the amplifier 30, and of the highest operating voltage which the circuit designer desires. In general, the level of current which the leaker 32 removes should be about 10% of the average current which the amplifier 30 is expected to have. In such a case, the maximum voltage on the CNBL line will be 100–150 mV more then its minimum.

The keeper transistors 16 of the prior art are eliminated in the present invention and instead, the EQ transistors 13 are kept open most of the time. EQ transistors 13 are only closed from the start of reading data from the relevant bit line 10 until after the data is latched on to an output line.

The circuit of FIG. 3A solves the wide operating range problem of the CNBL line for a device which can tolerate, during the standby mode, up to 200 μA of current due to the leaker 32. If, during the standby mode, the leaker 32 should become shut off or closed, the memory array of FIG. 3A would once again have a wide operating range. This is not acceptable.

Alternatively, in accordance with the present invention and as shown in FIG. 3B for the n-channel solution, the circuit can comprise high and low power units 40 and 42, respectively, both of which control the CNBL line and both of which have pull-up and leaker elements.

The high power unit 40 is only active when the memory array is in the active mode. In contrast, the low power unit is always active. Since, as will be explained hereinbelow, the low power unit is considerably smaller then the high power unit, widen the memory array is active, the activity of the low power unit hardly affects the activity of the memory array. However, when the high power unit is disabled, the low power unit controls the CNBL line. Therefore, in order to maintain the same operating point, the low power unit is designed to have the same operating voltage as the high power unit has. As a result, the circuit of FIG. 3B operates within a small voltage range for both operating modes.

Each unit is similar to the circuit of the previous embodiment. Thus, each has a amplifier unit and a leaker unit, each of which is connected to the CNBL line. Specifically, the high power unit 40 comprises a amplifier unit 44 and a leaker unit 46. Amplifier unit 44 comprises a high power amplifier 54 whose source S is connected to the CNBL line and a p-channel amplifier control transistor 56 connected between the positive supply Vdd and the drain D of amplifier 54. The leaker unit 46 typically comprises a high power leaker 58 whose drain D is connected to the CNBL line and a leaker control transistor 60 connected between the ground supply Vss and the source S of leaker 58. The gates G of amplifier 54 and leaker 58 are controlled by the blvref signal and the gates G of control transistors 60 and 56 are respectively controlled by an enable signal enb and its inverse signal, enb_b.

For the p-channel embodiment described hereinabove, the control transistors 56 and 60 are replaced by an n-channel control transistor and a p-channel transistor, respectively.

When the control transistors 56 and 60 are activated, they respectively enable the amplifier 54 to pull the CNBL voltage level $V_{CNBL}$ towards the positive supply Vdd and the leaker 58 to pull the CNBL, voltage level $V_{CNBL}$ towards the ground supply Vss. As in the circuit of FIG. 3A, when there is no other activity in the array and the control transistors 56 and 60 are activated (i.e. the memory stray is in the active mode), the CNBL current level is determined by the amount of current which the high power leaker 58 removes. When there is activity in the array, the current level is at of the array increased by the small amount or current removed by high power leaker 58.

When the control transistors 56 and 60 are deactivated, which occurs during the standby mode, transistors 54 and 58 are no longer connected to their respective supplies Vdd and Vss and thus, only the low power unit 42 is then active, as will be described in more detail hereinbelow.

As in the previous embodiment, the amplifier 54 is typically larger then the leaker 58 by approximately a few orders of magnitude depending on the desired voltage movement. In FIG. 3B, the sizes of the two transistors are given as $W/L_1$ for transistor 54 and $(W/1000)/L_2$ for leaker 58. For example, W might be 2000 μm, $L_1$ might be 1.1 μm and $L_2$ might be 4 μm. The example provides a voltage of 1.8 V on the CNBL line.

The low power unit 42 comprises a low power amplifier 70 and a low power leaker 72, each controlled by the blvref signal. Low power amplifier 70 is typically smaller then high power amplifier 54, by a few orders of magnitude, for example, by a factor of 1000. Accordingly, low power amplifier 70 operates according to the current-voltage graph labeled 64 in FIG. 4. For the same blvref, the operating point of low power amplifier 70 is the point labeled 66 on graph 64.

For example, FIG. 3B shows the size of low power amplifier 70 to be three orders of magnitude smaller then amplifier 54, or $(W/1000)/L_1$. The size ratio between the low power amplifier 70 and the low power leaker 72 is the same as for the high power amplifier 54 and its high power leaker 58. To match the example given hereinabove, the leaker 72 has to be approximately 1000 times smaller. FIG. 3B shows this as $W_2/L_3$. For the example given hereinabove, the leaker has a size of 1/2000 and removes current of 200 nA.

The current removed from the CNBL line by low power leaker 72 (Which is always active) is insignificant when the memory array is in the active mode since the current which low power leaker 72 removes is, 1000 times smaller then that removed by the high power leaker 58. However, in the standby mode, when the high power unit 44 is deactivated, the current removed by low power leaker 72 is the only current and it defines the highest voltage level of the CNBL line.

It will be appreciated that, by having two pairs of amplifiers and leakers both of which operate in one operating range whose highest voltage level is defined, the operating range of the circuit of FIG. 3B generally does not change much with temperature or process conditions.

Reference is now made to FIG. 5 which illustrates the temperature dependence of the CNBL voltage, for a 4.5 V blvref voltage, in standby mode in the prior art (graph 80) and in the low and high power modes of the present invention (graphs 82 and 84, respectively). The voltage levels of the low and high power modes are the worst case voltages and occur when the memory array is in the active mode but is reading a plurality of 0's on a single bit line.

As can be seen, for the current invention, the worst case CNBL voltage level varies very little over the entire temperature range. For example, FIG. 5 shows that the worst case CNBL voltage level, for the present invention, is at 2.2 V at −55° C. and at 2.1 V at 150° C. and that the maximum voltage variation, at 150° C., is 75 mV between the standby (curve 82) and active (curve 84) modes.

This contrasts with the prior art whose worst case CNBL voltage swings, in standby mode, from 2.8 V at −55° C. to 2.5 V at 150° C. In the active mode, the prior art operates similar to graph 82 for the high power mode of the present invention. Thus, the prior art has a voltage swing from 2.8 V in the standby mode to 2.15 V in the high power mode (at −55° C.) or a voltage change of 650 mV. The maximum range is from 2.8 V in standby mode at 55° C. to 1.9 V in the active mode at 150° C. or a 900 mV variation.

It will be appreciated by persons skilled in the art that the present invention is not limited to what has been particularly shown and described hereinabove. Rather the scope of the present invention is defined by the claims which follow:

We claim:

1. A unit for setting a minimum spread of voltage level for a capacitive node having variable current capability and a voltage level which varies between positive and ground supply voltage levels, the unit comprising:

a switchable high power unit activatable during an active mode; and a low power unit;

wherein each power unit is connected between positive and ground supplies and each power unit comprises:

an amplifying transistor connected to said capacitive node, and one of said positive and ground supplies wherein said amplifying transistor is controlled by a bit line reference signal, and said amplifying transistor has a first width/length ratio; and a leaker transistor connected to said capacitive node, and to a different one of said positive and ground supplies different from the one connected to said amplifying transistor;

wherein said leaker transistor is controlled by said bit line reference signal, and said leaker transistor has a second width/length ratio;

said second width/length ratio of said leaker transistor is much smaller then said first width/length ratio of said amplifying transistor; said first width/length ratio of said amplifying transistor of said switchable high power unit is much larger then said first width/length ratio of said amplifying transistor of said low power unit;

said bit line reference signal is a signal whose voltage level is higher then threshold levels of said amplifying transistor and leaker transistor of said low and high power units; and said switchable high power unit also comprises:

an amplifying transistor enable line;

a leaker transistor enable line;

an amplifying transistor control transistor connected to said amplifying transistor enable line and to said high power unit amplifying transistor wherein in response to a signal on said amplifying transistor line in said active mode, said high power unit amplifying transistor is activated; and a leaker transistor control transistor connected to said leaker transistor enable line and to said high power unit leaker transistor wherein in response to a signal on said leaker transistor enable line in said active mode, said high power unit leaker transistor is activated.

2. A unit according to claim 1 and wherein said amplifying transistors, leaker transistors, and leaker control transistor are n-channel transistors and said amplifier control transistor is a p-channel transistor.

3. A unit according to claim 1 and wherein said amplifying transistors, leaker transistors, and leaker control transistor are p-channel transistors and said amplifier control transistor is a n-channel transistor.

4. A unit for setting a minimum spread of voltage level for a capacitive node having variable current capability and a voltage level which varies between positive and ground supply voltage levels, the unit comprising:

a low power unit comprising:

a low power amplifying transistor connected between said capacitive node and one of positive and ground supplies and having a first width/length ratio wherein said low power amplifying transistor is controlled by a bit line reference signal; and a low power leaker transistor connected between said capacitive node and a different one of said positive and ground supplies different from the one connected to said low power amplifying transistor, and having a second width/length ratio, wherein said low power leaker transistor is controlled by said bit line reference signal;

said second width/length ratio of said low power leaker transistor is much smaller then said first width/length ratio of said low power amplifying transistor; and a switchable high power unit activatable during an active mode comprising:

an amplifying transistor control transistor connected to one of said positive and ground supplies, wherein said amplifying transistor control transistor is activatable during said active mode;

a high power amplifying transistor connected between said capacitive node and said amplifying transistor control transistor, and having a third width/length ratio wherein said high power amplifying transistor is controlled by said bit line reference signal;

a leaker transistor control transistor connected to a different one of said positive and ground supplies different from the one connected to said high power amplifying control transistor wherein said leaker transistor control transistor is activatable during said active mode; and a high power leaker transistor connected between said capacitive node and said leaker transistor control transistor, and having a fourth width/length ratio wherein said high power leaker transistor is controlled by said bit line reference signal, wherein said fourth width/length ratio of said high power leaker transistor is much smaller then said third width/length ratio of said high power amplifying transistor;

said third width/length ratio of said high power amplifying transistor is larger that said first width/length ratio of said low power amplifying transistor; and said bit line reference signal is a signal whose voltage level is higher then threshold levels of said high and low power amplifying transistors and leaker transistors.

5. A unit for setting a minimum spread of voltage level for a capacitive node having variable current capability and a voltage level which varies between positive and ground supply voltage levels, the unit comprising:

a switchable high power unit activatable during an active mode; and a low power unit;

wherein each power unit is connected between positive and ground supplies and each power unit comprises:

an amplifying transistor connected to said capacitive node, and to one of said positive and ground supplies wherein said amplifying transistor is controlled by a bit line reference signal; and a leaker transistor connected to said capacitive node and to a different one of said positive and ground supplies different from the one provided to said amplifying transistor, wherein said leaker transistor is controlled by said bit line reference signal; and wherein a maximum current of said leaker transistor is much smaller than a maximum current of said amplifying transistor.

* * * * *